United States Patent [19]

Onderka

[11] 4,091,715

[45] May 30, 1978

[54] HYDRAULIC SYSTEM FOR OPENING AND CLOSING HOPPER BARGES

[75] Inventor: Georg Onderka, Metten, Germany

[73] Assignee: Deggendorfer Werft und Eisenbau G.m.b.H., Germany

[21] Appl. No.: 683,761

[22] Filed: May 6, 1976

[30] Foreign Application Priority Data

May 30, 1975 Germany ..... 2523823

[51] Int. Cl.[2] ..... F01B 25/26

[52] U.S. Cl. ..... 91/1; 91/420; 91/445; 91/459; 91/461

[58] Field of Search ..... 91/390, 170 MP, 1, 420, 91/445, 459, 461

[56] References Cited

U.S. PATENT DOCUMENTS

| | | | |
|---|---|---|---|
| 2,657,028 | 10/1953 | Joy | 91/170 MP |
| 3,164,066 | 1/1965 | Frye | 91/170 MP |
| 3,736,845 | 6/1973 | Weiste | 91/390 |
| 3,924,689 | 12/1975 | Manor | 91/390 |
| 3,943,824 | 3/1976 | Fletcher | 91/420 |
| 3,990,583 | 11/1976 | Nishida | 91/420 |

FOREIGN PATENT DOCUMENTS

| | | | |
|---|---|---|---|
| 1,483,900 | 3/1969 | Germany | 91/170 MP |

*Primary Examiner*—Martin P. Schwadron
*Assistant Examiner*—Abraham Hershkovitz
*Attorney, Agent, or Firm*—McGlew and Tuttle

[57] ABSTRACT

A hydraulic system for opening and closing hopper barge comprises at least one and preferably two fluid pressure cylinders which are adapted to be positioned on one of the barge parts and a piston which is slidable in the cylinder which is adapted to be connected through its piston rod to the other barge part. The cylinder is connected by a first conduit at its piston rod end and by a second conduit at the opposite end, and a pump and a return line are connected to the respective first and second conduits. A pilot valve is located in the first and second conduits and includes three separate positions. In one position a pump discharge is connected to one end of the cylinder and the other end is connected to the return, and in another position, the opposite is true. In a third position, the first conduit is connected to a check valve and the pump discharge is connected to a return line in order to short circuit the pump. One end of the cylinder, for example one having the first circuit, is provided with a check valve arrangement which permits the piston to be locked in its position in the cylinder, preventing return flow except upon the occurrence of a predetermined excess of pressure. The check valves permit relief of the pressure throughout the connective system. Before the check valve locking system is opened, the pressures lines to the associated piston are checked by an electrohydraulic pressure switch, and for this purpose a second pilot valve is connected in the first and second conduits for selectively connecting them to the pressure side of the pump or the return line.

4 Claims, 1 Drawing Figure

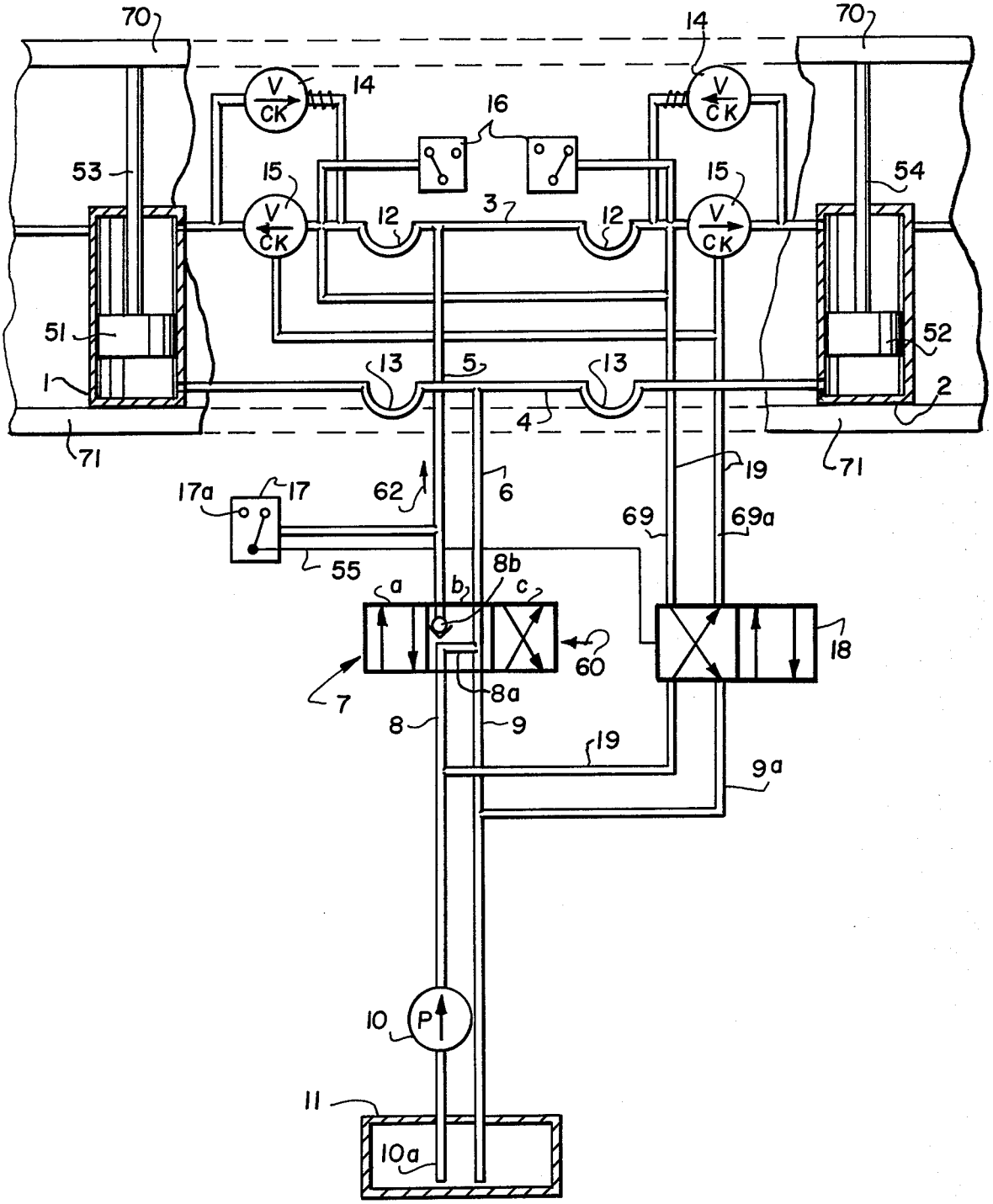
70
14
70
14
16
53
15
15
54
3
12
12
51
52
13
5
13
1
2
4
71
71
19
17a
17
62
6
69
69a
55
8b
a
b
c
18
60
7
8a
8
9
19
9a
10
P
11
10a

HYDRAULIC SYSTEM FOR OPENING AND CLOSING HOPPER BARGES

FIELD AND BACKGROUND OF THE INVENTION

This invention relates in general to the construction of control systems for operating barges and in particular to a new and useful hydromechanical control mechanism for operating the opening and closing mechanism of a hopper barge.

DESCRIPTION OF THE PRIOR ART

Hopper barges are used for transporting various materials including dredge materials, garbage, etc. The hoppers are made up of two ship half-parts which are articulated to each other in a longitudinal direction, and they are held in either an opened or a closed position by a piston rod connected to one section which is movable in a cylinder which is connected in the other section. Preferably two working cylinders are provided at each end of the barge, and they are connected through a parallel hydraulic system to a fluid pressure circulating pump into a return line leading to a fluid medium storage tank. In such an arrangement, elastic elements generally in the form of hoses must be arranged in the hydraulic pipe system because of the relative movements and inner deformations of the two barge halves. Such hose connections develop leakage which jeopardize the proper operation of the entire arrangement. This uncertainty is particularly critical if it results in the opening of the loaded barge at the improper time.

SUMMARY OF THE INVENTION

The present invention provides a hydraulic system which includes a supervising arrangement to ensure that none of the operating parts have improper pressure conditions. The system includes electrohydraulic pressure switches connected to the conduit system as control elements for the orderly state of the elastic connecting elements. Such pressure switches supervise the maintenance of the line pressure when the barge is loaded and provide independently thereof the prerequisite for unlocking of a locking check valve system. In addition they indicate the readiness for the start of the opening process.

The elastic connection elements which must be supervised are particularly those located in lines leading to the piston rod sides of the working cylinders and they are arranged in front of check valves which open in the direction of the working cylinders. According to another feature of the invention, an electrohydraulic pressure switch supervises the ordinary pressure state of the pipe system and permits the opening of the barge only when pressure conditions are favorable. The hydraulic system includes a pilot valve having 3 separate settings, 2 for switching the pressure medium from one side of the piston to the other, and a third for short circuiting the pressure pump during a time at which the pressure conditions are checked in the connecting lines which have the flexible hose couplings. Since the barge sections are held in a closed position by the check valve locking system which maintains the pressure on the piston, it is desirable to determine the pressure conditions downstream of such check valves when unlocking of the check valve locks and opening of the barge is to be accomplished. This is effected automatically by a second pilot valve and by an electrohydraulic pressure switch which provides a signal when the unlocking of the piston is desirable, so that the other pilot valve may be switched to unload the system.

Accordingly it is an object of the invention to provide an improved hydraulic system for hopper barges which includes a pressure system arrangement connected to the hydraulic line system for checking the orderly state of the hydraulic line system which of necessity includes elastic connecting elements, and which provides means for determining the pressure at which the piston and cylinder combination may be connected for unloading the piston, holding the barge in either an opened or a closed position.

A further object of the invention is to provide a system for the control of the opening and closing of barges which is simple in design, rugged in construction and economical to manufacture.

For an understanding of the principles of the invention, reference is made to the following description of typical embodiments thereof as illustrated in the accompanying drawings.

BRIEF DESCRIPTION OF THE DRAWINGS

The only FIGURE in the drawings is a schematic representation of a hydraulic system for operating two fluid piston and cylinder combinations for opening and closing a barge constructed in accordance with the invention.

GENERAL DESCRIPTION OF THE PREFERRED EMBODIMENTS

Referring to the drawings in particular, the invention embodied therein comprises an apparatus for opening and closing two barge halves 70 and 71 which includes a pair of working cylinders 1 and 2 which are mounted on one part 71 of the barge and which carry pistons 51 and 52 which are slidable therein and which have rod portions 53 and 54, which are connected to the respective other part 70 of the barge. The piston rods 53 and 54 extend through one end of their associated cylinders; this end is connected through a first conduit 3 and the opposite ends are connected to a second conduit 4. The first conduit 3 includes a section or portion 5 and the second conduit 4 includes a section or portion 6 located on one side of a first pilot valve generally designated 7. The opposite sides of the pilot valve are connected to a continuation of the first and second conduits in the form of a pressure line 8 connected to the discharge of a pump 10, and a return line 9 connected to a reservoir or pressure medium supply tank 11. The pump 10 also takes suction through a line **10*a* extending into the pressure medium tank 11**.

The first and second conduits 3 and 4 contain hose couplings 12, 12 and 13, 13 respectively in order to provide for flexible expansion of these lines. The first conduit also contains respective sets of check valve locking means in the form of check valves 14 and 15 associated with each cylinder 1 and 2 and with the valve 14 opening in an opposite direction to the valve 15. The valves 14 and 15 are located between the housing coupling 12 and the associated working cylinders 1 and 2. The check valves 14 and 15 are designed to be opened only against a predetermined certain spring pressure.

In accordance with a feature of the invention, an electrohydraulic pressure switch 16 is associated with each check valve 15. A similar electrohydraulic pressure switch 17 is connected to the section 5 of the first conduit and it is connected through an electrical circuit 55 to a second pilot valve 18. Pilot valve 18 is connected hydraulically through connecting lines 19 to the associated check valve 15.

If the empty hopper barge is to be closed, the pilot valve 7 is shifted away from the position *b* indicated in the drawings which includes a non-return valve 8*b* and in which the pump is short circuited so as to discharge through the first conduit section 8 and to return to the second conduit return 9 through a return line 8*a*, to the pressure medium tank 11, to a position in which the pump discharges in the first conduit 8 and continues through the section 5 to the first conduit portion 3 leading to the associated cylinders 1 and 2 at the piston rod ends thereof. With the pilot valve 7 in the position *a*, which position is effected by shifting the valve to the right against the direction of the arrow 60, the flow is in the direction of the arrow 62 through the section 5 and into the conduit 3. The return is back through the second conduit 4 and return section 6 in the return line 9 to the reservoir 11.

In the closed state of the hopper barge, the working cylinders 1 and 2 are thus admitted at the piston rod end and they are locked by check valves 14 and 15. The check valves 14 are under such a high spring pressure in the closing sense, that they open slightly when the respective working cylinder is temporarily under a higher pressure, such as during the loading of the barge, than is the other working cylinder. Then pressure equalization takes place between the two working cylinders 1 and 2. The spring loaded check valve 14 serves for each cylinder as a pressure limiting valve. If the barge is closed and loaded, accidental opening of the barge is not possible because of the self-locking of the check valves 15.

Before the check valves 15 are unlocked to open the hopper barge, the pilot valve 7 is shifted to the position *b* as indicated in the drawing, in order to check the orderly state of the hydraulic system. In this state the pump 10 is short circuited so that it discharges through the pressure line 8 and returns directly into the return line 9 through a return line 8*a* and to the reservoir 11. In this position, pressure in line 5 is maintained by non-return value 8*b*. The pump can also be stopped during this time is so desired. The sensing means in the form of an electrohydraulic pressure valve or switch 17 then checks the pressure in the section 5 of the first conduit 3 to determine whether the pressure is being maintained or drops due to the untightness in the range of the hose coupling 12. If the line pressure should drop, this state is indicated by a signal lamp 17*a* or by a sound indicator. The trouble must then be eliminated before the check valves 15 are unlocked.

If the line pressure remains constant, however, the second pilot valve 18 will be automatically actuated by means of the pressure valve or switch 17 to unlock the check valves 15 through the control lines 19 by admission against the closing pressure acting on it and thus opening them hydraulically. For this purpose the connecting lines 19 connect to a first conduit 3 at the location of the section 8 which is on the high pressure side of the pump 10 and a second connecting line 9*a* connects to the return line 9 of the second conduit 4. Line 69 and 69*a* interconnect with the respective locking check valves 15, 15 and depending upon whether the position of the pilot valve is as indicated or in a second position to the right of the indicated position, there will be fluid pressure delivered to the valve 15 on the right-hand side of the drawing or the valve 15 on the left-hand side of the drawing respectively.

The pressure switches 16 indicate by a light or a similar signal, when the valves 15 are being unloaded. Only then can the pilot valve 7 be moved into the position *c*, in which the barge is opened by emptying the space on the rod side of the piston 51 by connecting the first conduit 3 and the section 5 to the return line 9. Pressure medium at such time is delivered by the pump 10 through the lines 8, 6 and second conduit 4.

It is not necessary to check the couplings 13 and the line 4 for absolute tightness because the opening of the loaded barge is generally already effected at least partly by the pressure of the load. At any rate, no severe damage can be caused if these hose couplings 13 should not be completely tight.

While specific embodiments of the invention have been shown and described in detail to illustrate the application of the principles of the invention, it will be understood that the invention may be embodied otherwise without departing from such principles.

What is claimed is:

1. A hydraulic system for opening and closing hopper barges, comprising at least one fluid pressure cylinder adapted to be positioned on one of the barge parts, a piston slidable in said cylinder and having a rod extending through an end of said cylinder and adapted to be connected to the other barge part, a first conduit having a hose coupling section capable of developing leaks and being connected to said cylinder adjacent the end through which said rod extends; a second conduit having a hose coupling section capable of developing leaks, and being connected to said cylinder adjacent the end opposite the end through which said piston rod extends; a pump having a discharge connectable to said first and second conduits; a return line connectable to said first and second conduits; a first pilot valve connected into said first and second conduits between said pump and the fluid pressure cylinder, and between said return line and the fluid pressure cylinder respectively; said first pilot valve having a first position communicating said pump discharge to said first conduit, and communicating said second conduit to said return line; a second position, said second position having a non-return valve and communicating said first conduit to said non-return valve, and communicating said pump discharge to said return line; and a third position communicating said second conduit to said pump discharge, and said first conduit to said return line; check valve locking means connected to at least one end of said cylinder and to the associated one of said first and second conduits, and having a valve seated with a predetermined bias to prevent fluid from said at least one cylinder end from being exhausted to the associated one of said first and second conduits to maintain a closing pressure on said cylinder and sensing means connected to said first conduit for sensing any pressure drop in said first conduit when said first pilot valve is in its second position whereby to detect a leak in the respective hose coupling section; wherein said sensing means is an electrohydraulic pressure valve and including a second pilot valve connected to said first conduit and to said check valve locking means for unloading said check valve locking means to permit sliding movement of said piston, said second pilot valve being further connected to said electrohydraulic pressure valve and being activated by said electrohydraulic pressure valve only when the pressure in said first conduit has been maintained.

2. A hydraulic system for opening and closing hopper barges, comprising at least one fluid pressure cylinder adapted to be positioned on one of the barge parts, a piston slidable in said cylinder and having a rod extending through an end of said cylinder and adapted to be connected to the other barge part, a first conduit having a hose coupling section capable of developing leaks and being connected to said cylinder adjacent the end through which said rod extends; a second conduit having a hose coupling section capable of developing leaks, and being connected to said cylinder adjacent the end opposite the end through which said piston rod extends; a pump having a discharge connectable to said first and second conduits; a return line connectable to said first and second conduits; a first pilot valve connected into said first and second conduits between said pump and the fluid pressure cylinder, and between said return line and the fluid pressure cylinder respectively; said first pilot valve having a first position communicating said pump discharge to said first conduit, and communicating said second conduit to said return line; a second position, said second position having a non-return valve and communicating said first conduit to said non-return valve, and communicating said pump discharge to said return line; and a third position communicating said second conduit to said pump discharge, and said first conduit to said return line; check valve locking means connected to at least one end of said cylinder and to the associated one of said first and second conduits, and having a valve seated with a predetermined bias to prevent fluid from said at least one cylinder end from being exhausted to the associated one of said first and second conduits to maintain a closing pressure on said cylinder and sensing means connected to said first conduit for sensing any pressure drop in said first conduit when said first pilot valve is in its second position whereby to detect a leak in the respective hose coupling section wherein said hose coupling sections include elastic connecting elements and said sensing means comprises an electrohydraulic pressure valve connected to said first conduit for detecting a change in pressure in said first conduit due to leakage through said couplings, said electrohydraulic pressure valve comprises a control switch, a second pilot valve connected to said control switch, said second pilot valve being further connected to said first conduit and said locking means, said second pilot valve being movable by said control switch to release and open said locking means only when the pressure in said first conduit has been maintained.

3. A hydraulic system according to claim 1 including an electrohydraulic pressure switch connected to said check valve locking means for indicating an excess pressure therein.

4. A hydraulic system according to claim 2 including a second electrohydraulic switch associated with said check valve locking means for indicating when said locking means is unlocked.

* * * * *